United States Patent [19]

Barendregt

[11] 4,371,089

[45] Feb. 1, 1983

[54] CONTAINER CLOSURE

[75] Inventor: Willem Barendregt, Baarn, Netherlands

[73] Assignee: Internationale Verpakking Maatschappij BV, Weesp, Netherlands

[21] Appl. No.: 299,387

[22] Filed: Sep. 4, 1981

[30] Foreign Application Priority Data

Sep. 8, 1980 [NL] Netherlands ..... 8005062

[51] Int. Cl.[3] ..... B65D 55/02

[52] U.S. Cl. ..... 215/256; 215/253

[58] Field of Search ..... 215/253, 254, 255, 256; 220/266, 270

[56] References Cited

U.S. PATENT DOCUMENTS 3,817,416 6/1974 Costa ..... 215/256 X 4,307,821 12/1981 McIntosh ..... 215/256 X

FOREIGN PATENT DOCUMENTS 1943349 8/1969 Fed. Rep. of Germany .

1948634 9/1969 Fed. Rep. of Germany .

7026205 7/1970 France .

*Primary Examiner*—George T. Hall

*Attorney, Agent, or Firm*—Fleit & Jacobson

[57] ABSTRACT

A container closure for sterilely packing fluids and provided with a neck and a cap lockable thereon, consisting of a cover portion and a skirt portion which are connectible through a single snap closure and in the non-connected condition are surrounded by a protective cap which prevents undesirable connection of cover and skirt portion and receiving sealingly relatively to the surroundings the cap attached on the container for ensuring the interior sterility of the container preceding the sterile filling of said container. The protective cap may be designed in such a way that it constitutes a cap sealing after the filling of the container.

5 Claims, 1 Drawing Figure

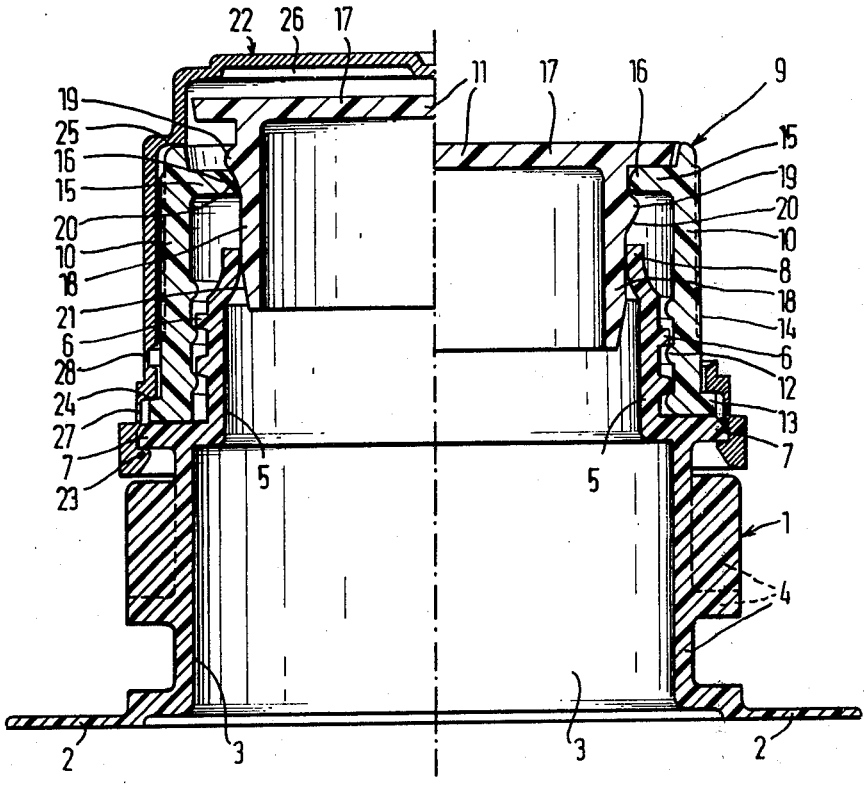
22
26
17
11
17
16
9
19
25
16
15
20
10
18
21
6
28
24
27
7
23
5
5
15
19
20
10
8
18
14
6
12
13
7
1
4
2
3
3
2

CONTAINER CLOSURE

The invention relates to a closure for a container for packing fluids, which closure is provided with a neck having exteriorly positioned closing means and with a cap comprising a cover portion and a skirt portion having interiorly positioned closing means which are adapted for coaction with the neck closing means, while the cover portion is connectible to the skirt portion through a single quick-closing attachment.

Such a container closure is disclosed in French Pat. No. 2,096,918 and serves on the one end for instantaneously detecting whether a container has or has not been already opened earlier and on the other end for providing a conveniently usable closure after the first opening. The cap, after the container has been filled, is thereby disposed together with the single snap closure in mounted condition on the container. For opening the container for the first time, the single snap closure should be broken by downward displacement of the skirt portion, so that the cover portion becomes freely accessible for removal purposes. After withdrawal of a part of the contents of the container, the cover portion and the skirt portion again are connectible through a further, multiple snap closure between both portions. As a result of this construction, the cap cannot be positioned until after the filling of the container and consequently should be transported and supplied to the filling apparatus detached from the container. This renders said container closure unsuitable for sterilely packaging goods, in particular but not exclusively fluids, which are often accommodated in a container consisting of a container closure attached to a plastic bag without natural rigidity, which is accommodated in a further rigid container. The bag is rendered sterile after its manufacture at least internally and shut off with normally a single screwed cap, transported and supplied to a filling apparatus where the cap is removed and is restored after the filling, which requires complicated apparatus, having a substantially inhibiting effect on the filling rate of the apparatus and, as has been found, does not at all ensure sterility.

It is the object of the invention to provided a closure through which the filling process can be rapidly executed, while in particular the sterility of the interior of the container is optimally ensured.

This is achieved according to the invention with a closure of the above described type when the cap adjacent the not yet connected skirt and cover portion is entirely surrounded by a cap which prevents undesirable connection of skirt portion with cover portion, while sealingly receiving the cap relatively to the surroundings. Through this feature there is obtained a closure allowing a highly rapid filling by removal of the cap and withdrawal of the cover portion, whereafter the filling may take place, followed by the insertion of the cover portion and its connection through the single snap closure to the skirt portion. Since this step substantially necessitates only longitudinal displacements, on the one hand the required time is to be kept relatively short, while moreover the combination of steps has become considerably simpler, which in particular in an automatized filling process produces substantial advantages. During the transport of a not yet filled container, the non-snapped in cover portion is maintained in position by the covering cap. The major property of the cap however is to maintain and ensure the sterility of the package during storage and transport to the filling location. By removing the covering cap only in or adjacent the filling apparatus in a sterile surrounding, the sterility of the container is excellently ensured, which even renders the present closure suitable as regards sterility for highly critical fluids to be packed, such as cream.

A relatively simple connection between closure and cap is obtained when in accordance with a further embodiment of the invention, the cap lockingly coacts with a projecting flange of the closure neck and finds support on the top face of the skirt portion. However it is preferable that the cap is locked by coaction of a first axial flange face with the bottom face of a projecting flange edge of the neck and of a second axial flange face with the top face of a projecting flange edge of the skirt portion of the cap. In case the natural rigidity of the cap will be too small for preventing, through axial pressure on the cap, the cover portion from being connected unintensionally to the skirt portion, the covering cap may likewise find support on the top face of the skirt portion.

The removal of the covering cap can be simply effected when the cap between the first and the second axial interface is provided with a first annular region with at least locally a reduced wall thickness. However it is preferred that the cap, relatively to the first region with reduced wall thickness, beyond the second axial flange face is provided with a second annular region with at least locally a reduced wall thickness. Upon removal of the cap for filling the bag, the cap will be released along the second region. In that case the cover portion becomes free for removal, after which the filling and re-positioning of the cover portion can take place. However, an annular portion of the protective cap has remained on the closure, which can be seen as a sealing between cap and neck. Thus, it is simply and effectively ensured that no unobserved removal and re-positioning of the cap can take place. On the one hand, this constitutes a protection against wrongful withdrawal of content from the package, while on the other hand this ensures that the sterility is not inadvertently lost, which is mainly of importance in case of critical, perishable goods, such as cream and the like.

One embodiment of the closure according to the invention will be now described, by way of example, with reference to the accompanying drawing. In the single enclosed drawing, the closure in the left-hand portion of the drawing is represented in the transport position for filling the container and in the right-hand portion in the transport position after the filling of the container.

The closure 1 in the drawing is depicted without the associated container, e.g. a plastic bag. For the connection of the closure 1 to such a container, use may be made of a flange 2. Adjoining the flange 2, there extends a hollow, cylindrical neck 3 comprising provisions 4 which may serve for securing and centering the closure 1 in a filling apparatus or a dispensing apparatus and for retaining the closure during the opening of the filled container. Since the provisions 4 are not of relevance to the present invention, they will not be further discussed.

The neck 3 furthermore is provided with a portion 5 having external screw thread 6. The lower end of the portion 5 is marked by a projection flange 7, while the top end has the shape of a converging end edge 8.

The neck 3 of the closure 1 is closable by means of a cap 9 comprising a skirt portion 10 and a cover portion 11. The skirt portion 10 is fitted with an internal screw thread 12 adapted for coaction with the external screw thread 6 on the portion 5 of the neck 3. The skirt portion 10 is enlarged at its lower end 13, while the enlarged bottom face is adapted for coaction with the flange edge 7 of the neck 3. On the outer circumferential surface of the skirt portion 10 there are provided ridges 14 which provide a better grip on the cap for the purpose of its rotation. Adjacent the top end the substantially cylindrical skirt portion 10 is fitted with an inwardly extending flange 15 whose free end face 16 is at least partly tapering and whose bore diameter exceeds that of the end edge 8.

The cover portion 11 comprises a circular plate 17 and a substantially cylindrical neck portion 18 extending therefrom. At a distance corresponding to the thickness of the flange edge 15 of the skirt portion 10, there is provided on the neck portion 18 of the cover portion 11 a thickening 19 which is provided with a locating edge 20 corresponding with the tapered end face 16 of the flange edge 15. The free end of the neck portion 18 is fitted with a bevel 21.

In the left-hand part of the FIGURE there is shown a protective cap 22 engaging with a snap edge 23 sealingly underneath the projecting flange edge 7 and with a snap edge 4 clampingly engaging on the top face of the enlarged lower end 13 of the skirt portion 10. The protective cap 22 is furthermore provided with a step 25 through which the protective cap 22 finds support on the top face of the skirt portion 10. The upper face 26 of the cap 22 may be profiled for stiffening same and/or engagement thereon. Between the snap edges 23 and 24 the protective cap is provided with a first annular region 27 of reduced wall thickness, which is formed by locally thinning the wall of the cap 22. Similarly a second annular region 28 is formed in the protective cap 22 above the snap edge 24.

The closure, in the position shown in the left-hand part of the drawing is supplied to a filling apparatus. After removal of the part of the protective cap 22 disposed above the region 28, which may be effected by making local cuts, the cover portion 11 slightly clampingly retained in the end edge 8 is accessible. After removal of the cover portion 11, the plastic bag connected to the closure 1 is freely accessible for being filled. Since the bore diameter of the flange edge 15 is larger than that of the end edge 8, a filling nozzle can be contacted easily in sealing relationship with the end edge, while the filling can take place without material arriving outside the neck 3. After completion of the filling, the cover portion 11 is inserted in the circular opening in the skirt portion 10, whereby a correct positioning of the cover portion is enhanced by coaction of in the first place the bevel 21 with the end edge 8 and subsequently the neck portion 18 with the end edge 8. After sufficient insertion of the cover portion 11, the locating edge 20 of the thickening 19 comes into contact with the tapered end face 16 of the flange edge 15. By exerting an axially directed pressure, the cover portion 11 will then be snappingly connected to the skirt portion 10, so that the situation is obtained as shown in the right-hand part of the drawing. It is observed that by a corresponding choice of diameter and thickness of the circular plate 17, a smooth configuration may be obtained of the cap 9 after the snapping of the cover portion 11 into the skirt portion 10, while at the same time unobserved removal of the cover 11 is prevented. Likewise, a reliable sealing of the plastic bag is obtained by coaction of the neck portion 18 with the end edge 8 of the neck 3.

After a short consideration, it will be clear that the entire above described filling process as of the breaking of the protective cap 22, can take place entirely in a sterile surrounding. In order to prevent that the sterility of the filled package is lost during the subsequent transport and storage by unauthorized persons, there is provided a further security in the form of the remaining annular portion of the protective cap 22, offering a sealing between cap and neck. This sealing may be broken by unscrewing the cap 9.

Consequently, the invention provides a closure through which a package can be filled in an optimally quick manner and which moreover allows and ensures an aseptic insertion and sealing of the content of the package. This likewise provides an additional protection against wrongful withdrawal of a part of the content of the package.

It is self-evident that many modifications and variants are possible within the scope of the invention. For instance it is naturally also possible to apply the single snap closure in the cylindrical wall portion of the skirt portion 10 instead of between the skirt portion 10 and the cover portion 11. Furthermore, also other conventional closure methods could be applied between neck 3 and cap 9 instead of the screw thread represented in the embodiment. Furthermore, the first region 27 could also be replaced by circumferentially distributed and axially extending grooves which would extend to beyond the snap edge 23.

It is also possible to design the first region 27 as a plurality of circumferentially provided perforations. These should then be applied after the filling of the container, since the sterile closure is ensured before the filling by coaction of the flange edge 7 with the contiguous edge of the protective cap and after the filling by coaction of the neck portion 18 with the narrowed end edge 8.

I claim:

1. A closure for a container for packing fluids, said closure being provided with a neck having exteriorly positioned closure means and with a cap consisting of a cover portion and skirt portion with interiorly disposed closure means adapted for coaction with the neck closure means, while the cover portion is connectible with a single snap closure to the skirt portion, characterized in that the cap, in case of not yet connected skirt and cover portion, is entirely surrounded by a protective cap which prevents undesirable connection of skirt portion to cover portion, as well as receives the cap sealingly relatively to the surroundings.

2. A closure according to claim 1, characterized in that the cap coacts lockingly with a projecting flange edge of the neck and finds support on the top face of the skirt portion.

3. A closure according to claim 1 or 2, characterized in that the cap is locked by coaction of a first axial flange face with the bottom face of a projecting flange edge of the neck and of a second axial flange with the top face of a projecting flange edge of the skirt portion of the cap.

4. A closure according to claim 3, characterized in that the cap between the first and the second axial flange face is provided with a first annular region of at least locally a reduced wall thickness.

5. A closure according to claim 4, characterized in that the cap relatively to the first region of reduced wall thickness beyond the second axial flange face, is provided with a second annular region of at least locally a reduced wall thickness.

* * * * *